United States Patent [19]

Pisani

[11] 4,231,142

[45] Nov. 4, 1980

[54] STOP MOTION FOR BAND CUTTING DEVICE

[75] Inventor: Luigi Pisani, Cilavegna, Italy

[73] Assignee: Officina Meccanica Pisani Luigi, Pavia, Italy

[21] Appl. No.: 835,021

[22] Filed: Sep. 20, 1977

[30] Foreign Application Priority Data

Oct. 29, 1976 [IT] Italy ..... 28835 A/76

[51] Int. Cl.[2] ..... B21D 43/26; B26D 3/16

[52] U.S. Cl. ..... 29/2.16

[58] Field of Search ..... 83/59, 66, 187; 29/2.16

[56] References Cited

U.S. PATENT DOCUMENTS 4,059,874 11/1977 Pisani ..... 29/2.16

FOREIGN PATENT DOCUMENTS 205967 7/1966 Sweden ..... 83/187

*Primary Examiner*—Robert Mackey

*Attorney, Agent, or Firm*—Stevens, Davis, Miller & Mosher

[57] ABSTRACT

In a band-cutting machine comprising a lower frame supporting a cloth-drawing mechanism, a control device for mechanically connecting the rotating parts of the machine, an upper rotatable frame positioned on said lower frame supporting a roll for cloth and a roller stretcher, the improvement which comprises a stop switch positioned on said lower frame, an actuator and a stretch detector carried on said upper rotatable frame, the detector actuating the stop switch through said actuator when the cloth is no longer in a stretched condition when passing through the roller stretcher.

4 Claims, 2 Drawing Figures

STOP MOTION FOR BAND CUTTING DEVICE

This invention relates to a band-cutting machine complete with stop for arresting the machine when the roll of cloth to be cut is exhausted.

The continuous strip, or band, of a constant width is generally made from a tubular fabric in rolls inserted on an upper rotating frame supported by a lower fixed frame. The lower fixed frame comprises a drawing device designed to give a cylindrical shape to the fabric, a cutting device for cutting a length of fabric corresponding to the size of the band it is intended to make, a control device and mechanical connection means for the rotating parts of the machine.

The upper rotating frame comprises also a roller-driven stretcher provided for keeping the fabric sufficiently stretched to ensure a constant width to the band.

A drawback of the known band-cutting machines, i.e., U.S. Pat. No. 3,271,838 and U.S. Pat. No. 4,059,874, is caused by the cloth being exhausted on the upper rotating frame, which then sags down on the roller-stretcher and is thus, no longer subjected to a constant stretching.

The band obtained from the end part of the roll which is being exhausted thus has a different width which is no longer equal to that obtained from the constantly stretched material.

The object of this invention is, therefore, to obviate the above-mentioned drawback, that is, the technical problem, which this invention proposes to resolve, is the automatic interruption of the band-cutting machine as soon as the roll of cloth is exhausted while at the same time allowing the machine to continue to run semiautomatically for cutting also the end length of cloth under conditions ensuring the constant width of the band obtained from the end part of the roll.

The above-mentioned technical problem is resolved by a machine of a type provided with a stopping device for detecting the tension acting on the upper rotating frame which is actively connected to actuator means designed for cyclically controlling interruptor means carried by the fixed lower frame. The detector means is actuated by the stretched cloth. Switching means are provided for interrupting the control device, when actuated by the actuators.

The advantages of the stopping device are reflected by the interruption of the band-cutting action as soon as the preset stretching force varies, allowing at the same time to manually continue the cutting process through the action of actuators, during each turn of the rotating frame, on the interruptors.

Under these conditions, the operator has the possibility of manually stretching the final part of the cloth and maintaining in this manner the optimum cutting conditions required for the cutting of the bands.

These and other advantages will now be evidenced by the following description of the machine accompanied by drawings, in which.

Figure 1:
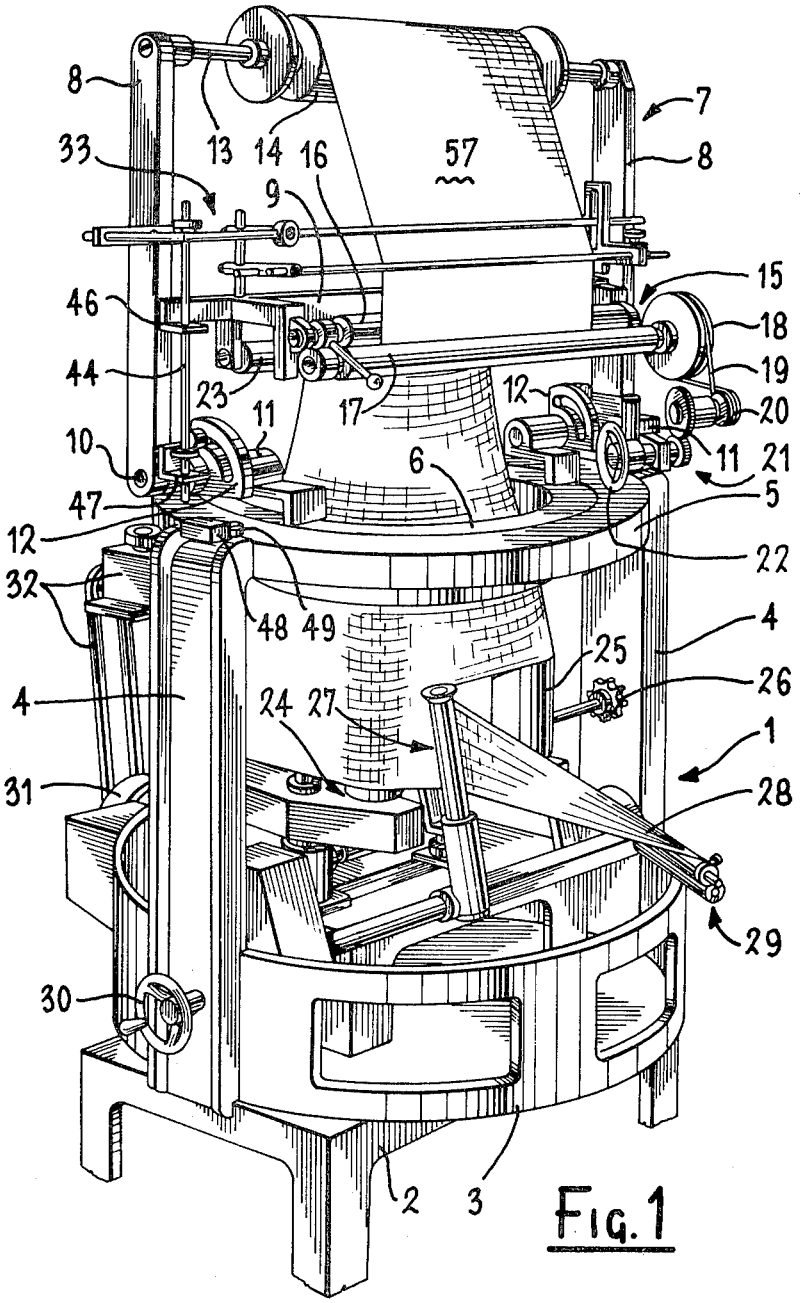
FIG. 1 is a view of a band-cutting machine.

With particular reference to FIG. 1, a band-cutting machine consists of a lower frame 1 comprising a base 2 carrying a supporting top 3. The supporting top 3 is fitted with two uprights 4 in diametrically opposed position carrying horizontally thereon an annular support 5. The annular support 5 carries in turn, a ring 6 of an upper rotatable frame. The ring 6 runs on suitable roller bearings (not shown). The frame 7 comprises two uprights 8, diametrically opposed and connected by a cross member 9. The uprights 8 are seated at their lower ends on pivots 10 each fixed to a support 11 integral to the ring 6.

The supports 11 are provided with grooved sectors 12 of the type allowing the tilting of the two uprights 8 with respect to the ring 6. The upper rotating frame 7 carries also a bar 13 provided for supporting a roll 14 of tubular cloth intended to be cut into continuous lengths, or bands, of the desired width.

The cross member 9 supports a stretching device 15 consisting of a couple of pressure rollers 16 and 17, rotatable in opposite directions by a pulley 18 connected through a transmission 19 to a pulley 20 of a transmission belt controlled by a common friction wheel 22 in contact with the annular support 5. The pressure rollers 16 and 17 unwind the cloth from the roll 14 which is frictionally mounted on the bar 13 to ensure it being fed well stretched to a feed roller 23 and from the feed roller 23 to a drawing device 24 inside the fixed frame 1.

The drawing device 24 consists substantially of a plurality of vertical drawing rollers 25 rotating in the same direction and tiltable by means of a control 26 to generate a drawing effect on the cloth. The device 24 feeds the cloth progressively toward a cutting device 27, thus ensuring the desired size of the band obtained.

The fixed frame 1 is provided with a common device 29 for the winding up of the so obtained band. The vertical drawing rollers 25 are, as known, adjustably spaced one from the other by means of a control 30 to ensure the substantially cylindrical shape of the cloth and to stretch the cloth sufficiently as a function of its perimetral length.

The fixed frame 1 also includes a control device 31 and mechanical connecting means 32 for the rotating parts of the here-described band-cutting machine.

Figure 2:
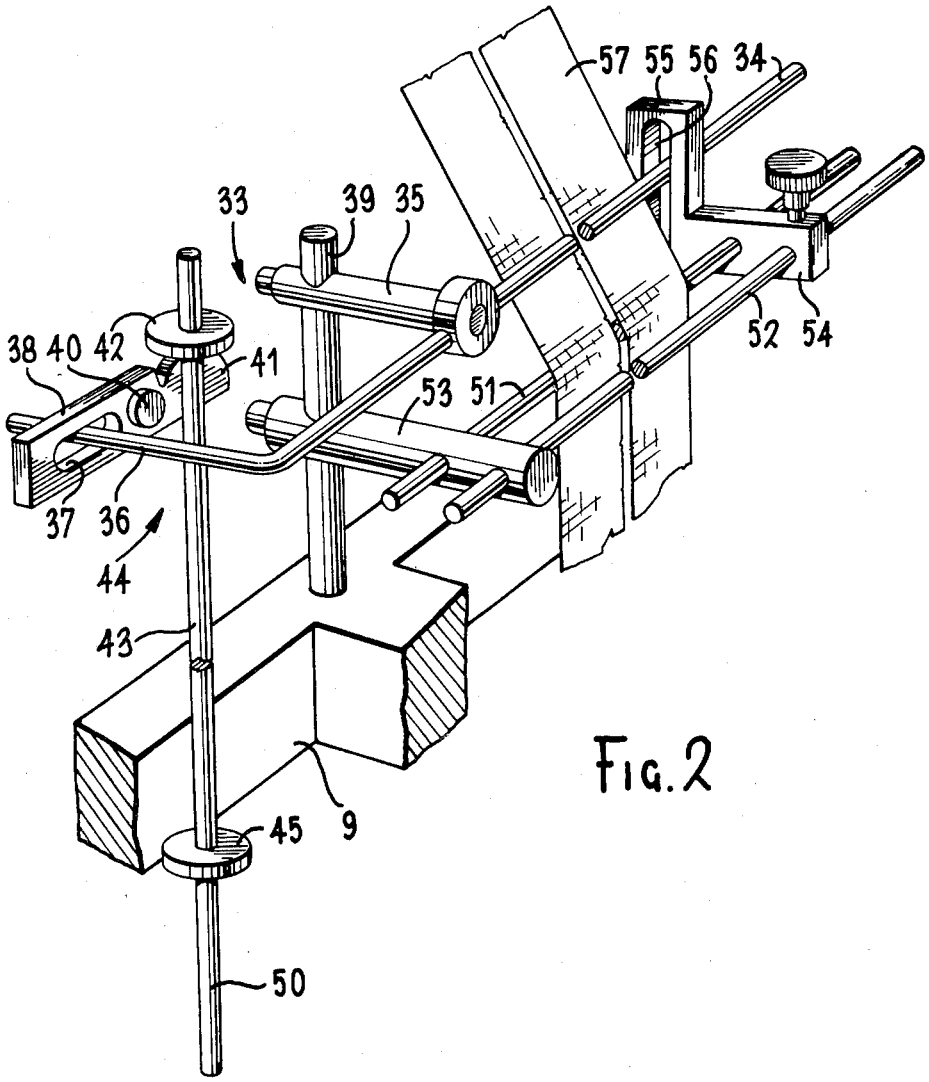
FIG. 2 is the stopping device fitted to the machine shown in FIG. 1.

Referring now to FIG. 2, the cross member 9 of the rotating frame 7 comprises a stopping device 33 for arresting the band-cutting machine once the cloth roll 14 is exhausted. This stopping device comprises cloth stretching detector means consisting of a rocker arm 34 oscillating around a horizontal pivot 35 with its end 36, which is not in contact with the cloth, freely seated in the slot 37 of a lever 38.

The pivot 35 is fixed to a vertical support 39 which is an integral part of the cross member 9. The lever 38 turns around a pivot 40 fixed to one of the uprights 8 of the rotating frame 7 and has a contact face 41 adhering to a locking ring 42 fixed to a vertical rod 43 of the actuator means 44. The vertical rod 43 carries an end-of-stroke 45 fixed to its lower end.

This vertical rod 43 is slidingly seated on two aligned supports 46 and 47 which are, integral parts of the upright 8. The lower support 47 acts as a guide for the vertical rod 43 and as a limit for its downward movement by engaging the end-of-stroke 45. The annular support 5 of the fixed frame 1 has fixed thereto switching means, for example a microswitch 48, whose actuator 49 lies in the path of movement of the lower end 50 of the rod 43. More precisely, the interaction between the end 50 and the actuator 49 happens only, when the cloth carried by the roll 14, is exhausted.

The switching means are operatively connected to the normal electrical supply circuit of the control device 31. The stopping device is completed by two guide bars 51 and 52 controlling the feed of the tubular cloth and projecting from a horizontal support 53 which is an integral part of the vertical support 39.

Onto the free end of the bars 51 and 52 is adjustably fixed a spacer 54 fitted with a tailpiece 55 having a vertical slot 56 therein, through which the rocker arm 34 passes to limit its oscillations.

The operation of the described band-cutting machine is as follows: The cloth, unwound from the roll 14, is passed below the rocker arm 34, then between the guide bars 51 and 52 and from there between the pressure rollers 16 and 17 of the stretcher device 15. After passing between the rollers 16 and 17, the cloth is opened up and inserted onto the drawing mechanism 24. The operation of the stopping device 33 is dependent upon the part of the cloth 57 between the bar 13 and the guide bars 51 and 52 being well stretched to keep the rocker arm 34 in a practically horizontal position, and thereby maintain the vertical rod 43 raised from the actuator 49 of the microswitch 48. When the cloth roll 14 is nearing its end, the length of the cloth 57 begins to sag down and is no longer able to support the rocker arm 34 which, now, swings downwardly. This downward rotation of the rocker arm causes the raising of its end 36 resulting in an oscillation of the lever 38 around the pivot 40. The shape of the lever 38 causes in this case the lowering of the contact 41 and, therewith the vertical rod 43. During the rotation of the frame 7, the rod 43 now interacts with the actuator 49, thus causing the interruption of the current to the control device 31 and the instantaneous stopping of the maching.

At this point, the operator sustains the length of cloth 57 with one hand to prevent the cloth from curling up between the pressure rollers. After the cloth has passed beyond the rollers, it falls down onto the drawing mechanism.

With the free hand, the operator raises the vertical rod 43 sufficiently to allow it to clear the actuator 49, and then lets it drop down again. This allows the machine to make a full turn because the vertical rod 43, again in its lowest position, will again contact the actuator 49 at the end of the said full turn.

The repetition of the single hand-controlled turns can be continued, until the whole length of cloth 57 is finished. This is made possible by the slow rotational speed of the rotating frame.

What I claim is:

1. In a band cutting machine comprising a stationary lower frame having a central axis, a cloth-feeding mechanism for advancing tubular material to be cut into strips supported by said frame, a cutting apparatus mounted on said frame to cut out said strips from said cloth-feeding mechanism, a driving device for the cloth feeding mechanism and the cutting apparatus and an upper frame carried on said stationary lower frame, said upper frame being rotatable about the central axis of the lower frame and supporting a roll for cloth to be cut into strips and a roller stretcher which serves as a means for guiding said cloth as it is drawn from said roll and an advancer to the cutting apparatus, the improvement which comprises a stop switch positioned on said lower frame, a vertically movable actuator means above said switch and a pivotable stretch detector means carried on said upper rotatable frame, said stretch detector means governing the vertical movement of said actuator means, said detector means pivoting when the cloth is no longer in a stretched condition when passing through the roller stretcher to lower said actuator which actuates the stop switch for arresting operation of the band cutting machine.

2. The band-cutting machine according to claim 1, wherein the stretch detector means are positioned between the roll for cloth and the roller stretcher, the said detecting means being influenced by the stretched part of the cloth between the said roll for cloth and the said roller stretcher.

3. The band-cutting machine according to claim 1, wherein said detector means comprise a rocker arm, a horizontal pivot for pivoting said rocker arm carried by the upper rotating frame with an end not in contact with the stretched cloth acting on the said actuator means supported by the upper frame.

4. In a band-cutting machine comprising a stationary lower frame having a central axis, a cloth-feeding mechanism for advancing tubular material to be cut into strips supported by said frame, a cutting apparatus mounted on said frame to cut out said strips from said cloth-feeding mechanism, a driving device for the cloth-feeding mechanism and the cutting apparatus and an upper frame carried on said stationary lower frame, said upper frame being rotatable about the central axis of the lower frame and supporting a roll for cloth to be cut into strips and a roller stretcher when serves as a means for guiding said cloth as it is drawn from said roll and an advancer to the cutting apparatus, the improvement which comprises a stop switch positioned on said lower frame, a vertically movable actuator means above said switch and a pivotable stretch detector means carried on said upper rotatable frame, said detector means comprising a rocker arm, a horizontal pivot for pivoting said rocker arm carried by the upper rotatable frame with an end not in contact with the stretched cloth acting on the said actuator means supported by the upper frame, said actuator means comprising a vertical rod, supports for sliding the rod therein which form an integral part of the upper frame, a top locking ring and an end-of-stroke fitting positioned on the top and bottom respectively of said rod, said top locking ring connected to interact with the free end of the rocker arm and said end-of-stroke fitting limiting the downward movement of the vertical rod, the said rod at its lower end designed to interact with the switching means for arresting operation of the band-cutting machine, when the absence of stretch in the cloth causes the rotation of the rocker arm around the horizontal pivot.

* * * * *